US006504322B2

(12) United States Patent
Takahashi et al.

(10) Patent No.: US 6,504,322 B2
(45) Date of Patent: Jan. 7, 2003

(54) DISCHARGE LAMP OPERATING APPARATUS

(75) Inventors: Kenichiro Takahashi, Osaka (JP); Satoshi Kominami, Osaka (JP); Masayoshi Gyoten, Shiga (JP); Koji Miyazaki, Osaka (JP); Mamoru Takeda, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/836,652

(22) Filed: Apr. 17, 2001

(65) Prior Publication Data

US 2001/0030514 A1 Oct. 18, 2001

(30) Foreign Application Priority Data

Apr. 18, 2000 (JP) ..... 2000-116055

(51) Int. Cl.[7] ..... H05B 37/02

(52) U.S. Cl. ..... 315/307; 315/200 R; 315/224; 315/225; 315/283; 315/287; 315/291

(58) Field of Search ..... 315/307, 119, 315/135, 200 R, 209 R, 224, 225, 283, 287, 291, 308, DIG. 4, DIG. 7

(56) References Cited

U.S. PATENT DOCUMENTS

| | | | | | |
|---|---|---|---|---|---|
| 4,949,016 | A | * | 8/1990 | De Bijl et al. | 315/208 |
| 5,422,548 | A | * | 6/1995 | Yamashita et al. | 315/224 |
| 5,485,059 | A | * | 1/1996 | Yamashita et al. | 315/307 |
| 5,663,613 | A | * | 9/1997 | Yamashita et al. | 315/225 |
| 5,705,898 | A | * | 1/1998 | Yamashita et al. | 315/151 |

FOREIGN PATENT DOCUMENTS

| | | | |
|---|---|---|---|
| JP | 11111486 | A | 4/1999 |

* cited by examiner

*Primary Examiner*—Don Wong
*Assistant Examiner*—Thuy Vinh Tran
(74) *Attorney, Agent, or Firm*—Harness, Dickey & Pierce, PLC

(57) ABSTRACT

A discharge lamp operating apparatus includes a discharge lamp and a driving circuit of the discharge lamp. The driving circuit can vary power to be supplied to the discharge lamp and has a function to turn off the discharge lamp at a supplied power value above a supplied power value at which unstable discharge occurs in the discharge lamp.

27 Claims, 12 Drawing Sheets

DISCHARGE LAMP OPERATING APPARATUS

BACKGROUND OF THE INVENTION

The present invention relates to a discharge lamp operating apparatus. In particular, the present invention relates to a discharge lamp operating apparatus for turning on and dimming a fluorescent lamp.

Fluorescent lamps are characterized by high efficiency and long lifetime, compared with incandescent lamps, and therefore widely used, especially for household illumination. In particular, compact self-ballasted fluorescent lamps are widely noted and spread because of their immediate substitutability for incandescent lamps.

In recent years, there has been a need for dimming fluorescent lamps in the same manner as in incandescent lamps. To meet this need, fluorescent lamps that can be dimmed are under development. In the case of incandescent lamps, which are not discharge lamps, the lamps can be dimmed comparatively easily by controlling the lamp power. On the other hand, in the case of fluorescent lamps, which are discharge lamps, dimming is not achieved satisfactorily simply by controlling the lamp power. Therefore, to dim fluorescent lamps, a phase-controlled AC voltage is input, and a lamp operating circuit is required to allow lighting with dimming.

FIG. 11 shows a circuit configuration of a conventional discharge lamp operating apparatus that allows lighting with dimming. The lamp operating apparatus shown in FIG. 11 includes a discharge lamp 12 and a driving circuit 26. The driving circuit 26 includes a DC power 4 and a DC/AC converting circuit 10, and a control circuit 16.

The DC power 4 rectifies a commercial AC power 1 with a diode bridge 2, smoothes the current with a smoothing capacitor 3, and outputs a DC voltage. The DC power 4 is connected in parallel to a series circuit of power MOSFETs 5 and 6, which are main switching elements. A LC resonance circuit including the discharge lamp 12, an inductor 7 for resonance, a capacitor 8 for resonance, a capacitor 9 for resonance and preheating current conduction is connected between the drain terminal and the source terminal of the power MOSFET 6.

The DC/AC converting circuit 10 is constituted by the power MOSFETs 5 and 6, the inductor 7 for resonance, the capacitor 8 for resonance, the capacitor 9 for resonance and preheating current conduction. The control circuit 16 is constituted by a power source part including a resistor 13 for power source and a zener diode 14 that are connected to the DC power 4, and a control circuit part 15. The control circuit part 15 is connected to the power MOSFETs 5 and 6, and the power to be supplied to the discharge lamp 12 is varied by varying the oscillating frequency or the ON duty of these switching elements. The control circuit 16 including the control circuit part 15 varies and controls the power to be supplied to the discharge lamp 12 in response to an instruction signal for dimming. Thus, the luminous flux of the discharge lamp is controlled for dimming.

FIG. 12 is a graph schematically showing the dimming state of the discharge lamp operating apparatus. The horizontal axis in FIG. 12 shows a dimming instruction, and the vertical axis shows the luminous flux level of the discharge lamp that changes in response to the dimming instruction.

FIG. 12 indicates that dimming can be achieved by varying and controlling the lamp power (curve B) in response to the dimming instruction. However, when the dimming instruction is made on the side of low luminous flux dimming in order to reduce the luminous flux, there is a problem in that unstable discharge occurs. The reason why unstable discharge occurs seems to be as follows. In a low luminous flux dimming region, it is necessary to control the power to be supplied (lamp power) to be small, so that it is necessary to constrict the lamp current. However, this results in very high lamp voltage (curve A) at the same time, as shown in FIG. 12. Thus, when the lamp voltage is so high as to be beyond the operating limit of the circuit, the circuit operation becomes unstable and thus unstable discharge such as a luminous lamp flashing on and off occurs. As a result, a stable dimming operation cannot be achieved from a full lighting state to a lighting off state, and a region where unstable discharge occurs as shown by a hatched region in FIG. 12 is generated. In lighting in the region where unstable discharge occurs, the lamp may flicker or flash on and off. In some cases, malfunction such as damage of the circuit during a low luminous flux dimming operation may occur.

SUMMARY OF THE INVENTION

Therefore, with the foregoing in mind, it is an object of the present invention to provide a discharge lamp operating apparatus that can realize stable dimming operation from a full lighting state to a lighting off state with a simple circuit configuration.

A discharge lamp operating apparatus of the present invention includes a discharge lamp and a driving circuit of the discharge lamp. The driving circuit can vary the power to be supplied to the discharge lamp and has a function to turn off the discharge lamp at a supplied power value above a supplied power value at which unstable discharge occurs in the discharge lamp.

In one embodiment, the driving circuit includes a DC power; a DC/AC converting circuit connected to the discharge lamp at its output terminal, including a switching element for converting an output from the DC power to alternating current; a control circuit for varying the oscillating frequency or the ON duty of the switching element, thereby varying and controlling the power to be supplied to the discharge lamp; a lamp characteristics detection circuit for detecting that the power supplied to the discharge lamp has reached a predetermined value; and a stop circuit for generating a signal for stopping an operation of the control circuit when the predetermined value is reached.

It is preferable that the lamp characteristics detection circuit includes a delay circuit for delaying an output signal for a predetermined time.

In one embodiment, the stop circuit generates a signal for stopping an operation of the control circuit while the stop circuit receives an output signal from the lamp characteristics detection.

In one embodiment, the discharge lamp operating apparatus is constituted as a compact self-ballasted fluorescent lamp.

In one embodiment, the driving circuit can vary the power to be supplied to the discharge lamp continuously or discretely, thereby dimming the discharge lamp continuously or discretely.

According to another aspect of the present invention, a discharge lamp operating apparatus includes a discharge lamp and a driving circuit of the discharge lamp. The driving circuit can vary the power to be supplied to the discharge lamp and has a function to turn off the discharge lamp at a supplied power value above a supplied power value at which unstable discharge occurs in the discharge lamp. The discharge lamp operating apparatus further comprises means for supplying the power for a dimming level of a full lighting state to the discharge lamp for a predetermined period of time, regardless of a dimming level of the discharge lamp operating apparatus.

In one embodiment, the driving circuit includes a DC power; a DC/AC converting circuit connected to the discharge lamp at its output terminal, including a switching element for converting an output from the DC power to alternating current; a control circuit for varying an oscillating frequency or an ON duty of the switching element, thereby varying and controlling the power to be supplied to the discharge lamp; a lamp characteristics detection circuit for detecting that the power supplied to the discharge lamp has reached a predetermined value; and a stop circuit for generating a signal for stopping an operation of the control circuit when the predetermined value is reached. The means for supplying the power for a full lighting state for a predetermined period of time includes a timer circuit that operates for a predetermined period of time in connection with a switch for turning on the AC power; and a full lighting dimming instruction signal generating part for generating a full lighting dimming instruction signal for setting a dimming level to a level for a full lighting state, in response to an output from the timer circuit and outputting the signal to the control circuit. The control circuit includes a function to process the full lighting dimming instruction signal from the full lighting dimming instruction signal generating part before a dimming instruction signal for varying and controlling the power to be supplied to the discharge lamp, whereby the power for the full lighting state is supplied to the discharge lamp.

According to the present invention, the power to be supplied to a discharge lamp can be varied. In addition, since the driving circuit has a function to turn off the discharge lamp at a supplied power value above the supplied power value at which unstable discharge occurs in the discharge lamp, the discharge lamp can turn off at a predetermined supplied power value, in addition to being dimmed by varying the power to be supplied to the discharge lamp. As a result, unstable discharge is prevented from occurring in the discharge lamp, so that stable dimming operation can be achieved from the full lighting state to the lighting off state. In the case where a lamp characteristics detection circuit included in the driving circuit has a delay circuit for delaying output signals for a predetermined time, a malfunction due to a high voltage pulse that occurs at the start of lighting of the discharge lamp can be prevented. In addition, when a stop circuit included in the driving circuit is a circuit for generating a signal for stopping the operation of the control circuit while output signals from the lamp characteristics detection circuit are input, the stop circuit can be realized with a simple configuration where a complicated circuit for storing a stop signal or a reset circuit is not required.

According to the present invention, the power to be supplied to the discharge lamp can be varied, and the driving circuit has a function to turn off the discharge lamp at a supplied power value above the supplied power value at which unstable discharge occurs in the discharge lamp. Thus, the present invention can provide a discharge lamp operating apparatus with a stable dimming operation without unstable discharge from the full lighting state to the lighting off stage.

Furthermore, in the case where the discharge lamp operating apparatus includes means for supplying the power for a dimming level of a full lighting state to the discharge lamp for a predetermined period of time, regardless of the dimming level of the discharge lamp operating apparatus, the discharge lamp operating apparatus easily can turn on the lamp again. In the case where the discharge lamp operating apparatus is constituted as a compact self-ballasted fluorescent lamp, it can be substituted for an incandescent lamp, so that the discharge lamp operating apparatus of the present invention can be applied in a wide range.

This and other advantages of the present invention will become apparent to those skilled in the art upon reading and understanding the following detailed description with reference to the accompanying figures.

DETAILED DESCRIPTION OF THE INVENTION

Hereinafter, embodiments of the present invention will be described with reference to the accompanying drawings. The present invention is not limited by the following embodiments.

Figure 1:
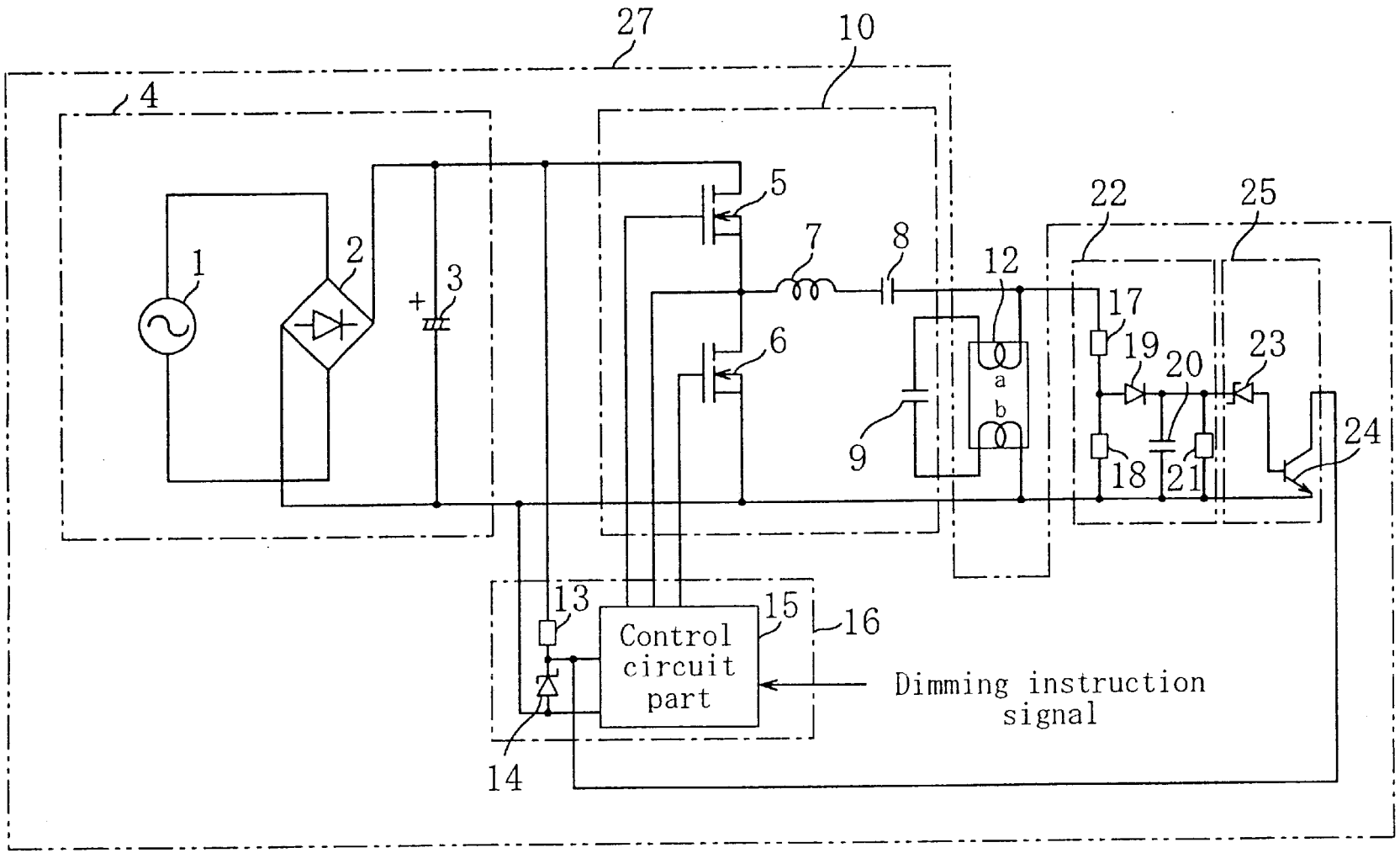
FIG. 1 is a diagram showing a configuration of a discharge lamp operating apparatus of an embodiment of the present invention.

FIG. 1 shows a configuration of a circuit of a discharge lamp operating apparatus of an embodiment of the present invention. The discharge lamp operating apparatus of this embodiment includes a discharge lamp 12, and a driving circuit 27 for the discharge lamp 12. The driving circuit 27 can vary the power to be supplied to the discharge lamp 12, and has a function to turn off the discharge lamp 12 at a supplied power value above the supplied power value at which unstable discharge occurs in the discharge lamp 12. Since the driving circuit 27 has such a function, a discharge lamp operating circuit that can perform stable dimming operation without unstable discharge from the full lighting state to the lighting off state can be realized. In other words, in a region where unstable discharge occurs (unstable discharge occurring region), flickers or flashing on and off are prevented by turning off the discharge lamp 12.

The driving circuit 27 of the discharge lamp of FIG. 1 includes a DC power 4, a DC/AC converting circuit 10, a control circuit 16, and a lamp characteristics detection circuit 22, and a stop circuit 25. The lamp characteristics detection circuit 22 and the stop circuit 25 mainly serve to turn off the discharge lamp 12 at a supplied power value above the supplied power value at which unstable discharge occurs in the discharge lamp 12.

More specifically, The driving circuit 27 of this embodiment includes the DC power 4 and the DC/AC converting circuit 10 including switching elements (5, 6) for converting outputs from the DC power 4 to alternating current. The discharge lamp 12 is connected to an output terminal of the DC/AC converting circuit 10. The switching elements (5, 6) are connected to the control circuit 16, and the control circuit 16 varies the oscillating frequency or the ON duty of the switching elements (5, 6), thereby varying and controlling the power to be supplied to the discharge lamp 12. The discharge lamp 12 is connected to the lamp characteristics detection circuit 22, and the lamp characteristics detection circuit 22 detects that the power supplied to the discharge lamp 12 reaches a predetermined value. The stop circuit 25 is connected to the lamp characteristics detection circuit 22. The stop circuit 25 generates a signal for stopping the operation of the control circuit 16 when the power supplied to the discharge lamp 12 reaches the predetermined value and outputs the signal to the control circuit 16.

Figure 11:
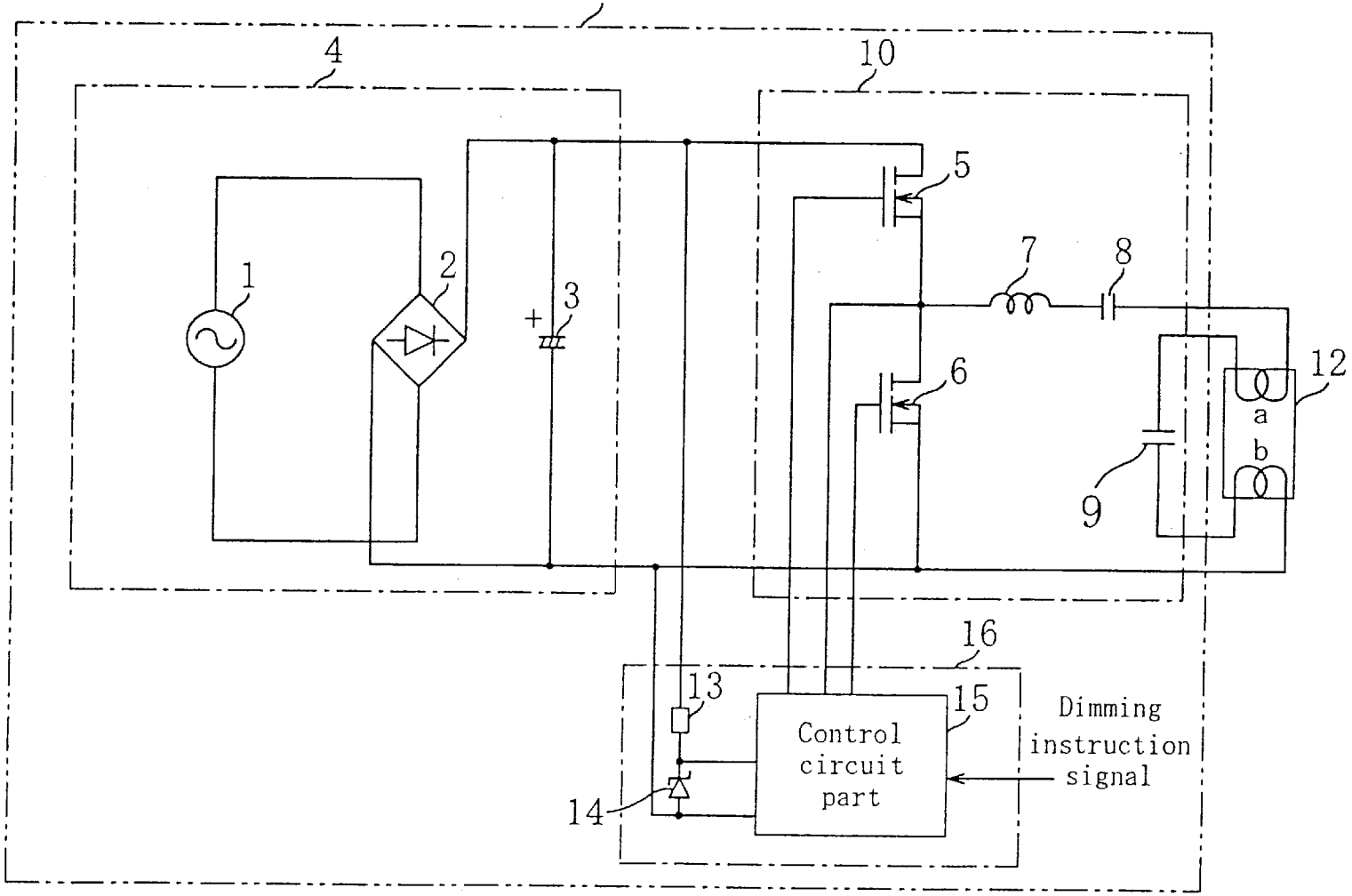
PRIOR ART Fig. 11
FIG. 11 is a diagram showing a configuration of a conventional discharge lamp operating apparatus.

As in the configuration shown in FIG. 11, the DC power 4 rectifies a commercial AC power 1 with a diode bridge 2, smoothes the current with a smoothing capacitor 3, and outputs a DC voltage. The DC power 4 is connected in parallel to a series circuit of power MOSFETs 5 and 6, which are switching elements. A LC resonance circuit including the discharge lamp 12, an inductor 7 for resonance, a capacitor 8 for resonance, a capacitor 9 for resonance and preheating current conduction is connected between the drain terminal and the source terminal of the power MOSFET 6.

As in the configuration shown in FIG. 11, the DC/AC converting circuit 10 is constituted by the power MOSFETs 5 and 6, the inductor 7 for resonance, the capacitor 8 for resonance, the capacitor 9 for resonance and preheating current conduction. The control circuit 16 is constituted by a power source part including a resistor 13 for power source and a Zener diode 14 that are connected to the DC power 4, and a control circuit part 15. The control circuit part 15 is connected to the power MOSFETs 5 and 6, and the power to be supplied to the discharge lamp 12 is varied by varying the oscillating frequency or the ON duty of these switching elements. The control circuit 16 including the control circuit part 15 can vary and control the power to be supplied to the discharge lamp 12 in response to dimming instructions.

Figure 12:
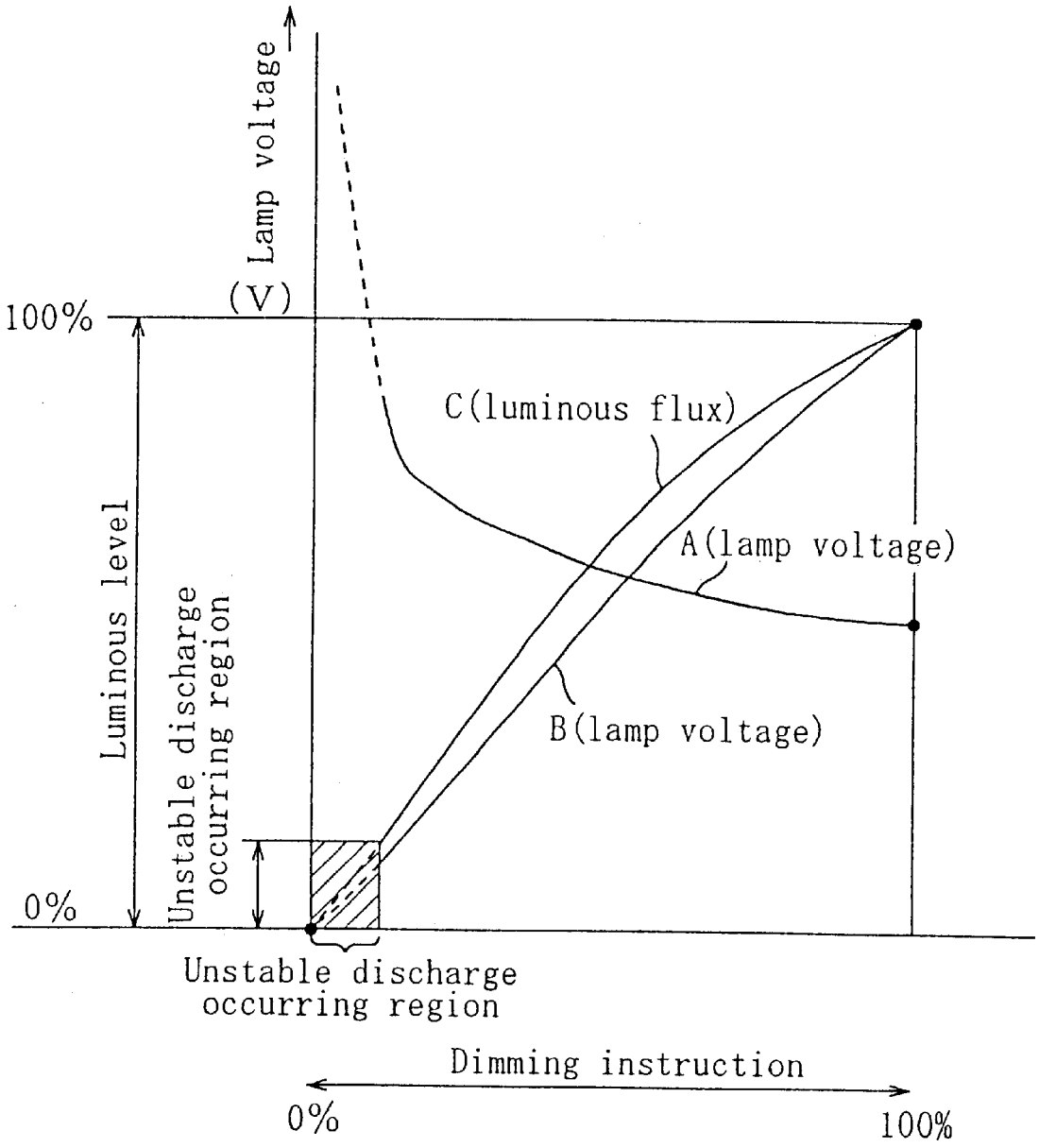
PRIOR ART Fig. 12
FIG. 12 is a graph showing the operation of the conventional discharge lamp operating apparatus.

The lamp characteristics detection circuit 22 has a function to detect that the power supplied to the discharge lamp 12 reaches a predetermined value, as described above. The lamp characteristics detection circuit 22 of this embodiment includes resistors 17 and 18, a diode 19, a capacitor 20, and a resistor 21. In order to detect the power supplied to the discharge lamp 12, a series circuit of the resistors 17 and 18 is connected in parallel to both terminals of the discharge lamp 12. As shown in FIG. 12, the supplied power is correlated to the voltage between the terminals of the discharge lamp, and therefore this embodiment utilizes this fact so that voltages obtained by dividing the voltage of the discharge lamp depending on the resistance ratio between the resistors 17 and 18 are detected, thereby detecting the supplied power. This configuration is advantageous in that the circuit configuration can be simple, compared with the case where the supplied power is detected directly. Although the circuit configuration may be complicated, a configuration is possible where the lamp current is also detected to detect the power supplied to the lamp.

Since the series circuit of the diode 19 and the capacitor 20 is connected to both terminals of the resistor 18, the voltage obtained by dividing the voltage of the discharge lamp with the resistor 18 is charged to the capacitor 20 via the diode 19. Here, the resistor 17 and the capacitor 20 constitute a delay circuit, thereby delaying the charging to the capacitor 20 for a certain period of time. The delay circuit of the capacitor 20 and the resistor 17 has a function to prevent the stop circuit from erroneously operating by a high voltage pulse that is generated at the start of lighting of the discharge lamp. In other words, the delay circuit serves to prevent the stop circuit from erroneously operating at the start of lighting of the discharge lamp and allow the stop circuit to operate in an unstable discharge occurring region. The operation of this delay circuit will be described more specifically later. The resistor 21 connected in parallel to the capacitor 20 is a resistor for discharging the capacitor 20.

The stop circuit 25 includes a Zener diode 23, and a transistor 24, which is a switching element. When the voltage charged to the capacitor 20 becomes higher than the total voltage of the Zener voltage of the Zener diode 23 and the forward voltage between the base and the emitter of the transistor 24, which is a switching element, base current flows through the transistor 24, and the transistor 24 turns on. The transistor 24 that is turned on causes the junction point between the resistor 13 for power source and the Zener diode 14 of the control circuit 16 to be short-circuited to the minus terminal of the DC power 4, thereby stopping supply of electricity to the control circuit part 15, so that the switches of the power MOSFETs 5 and 6 are stopped. As a result, the power to be supplied to the discharge lamp 12 is stopped so that the discharge lamp 12 turns off.

Figure 2:
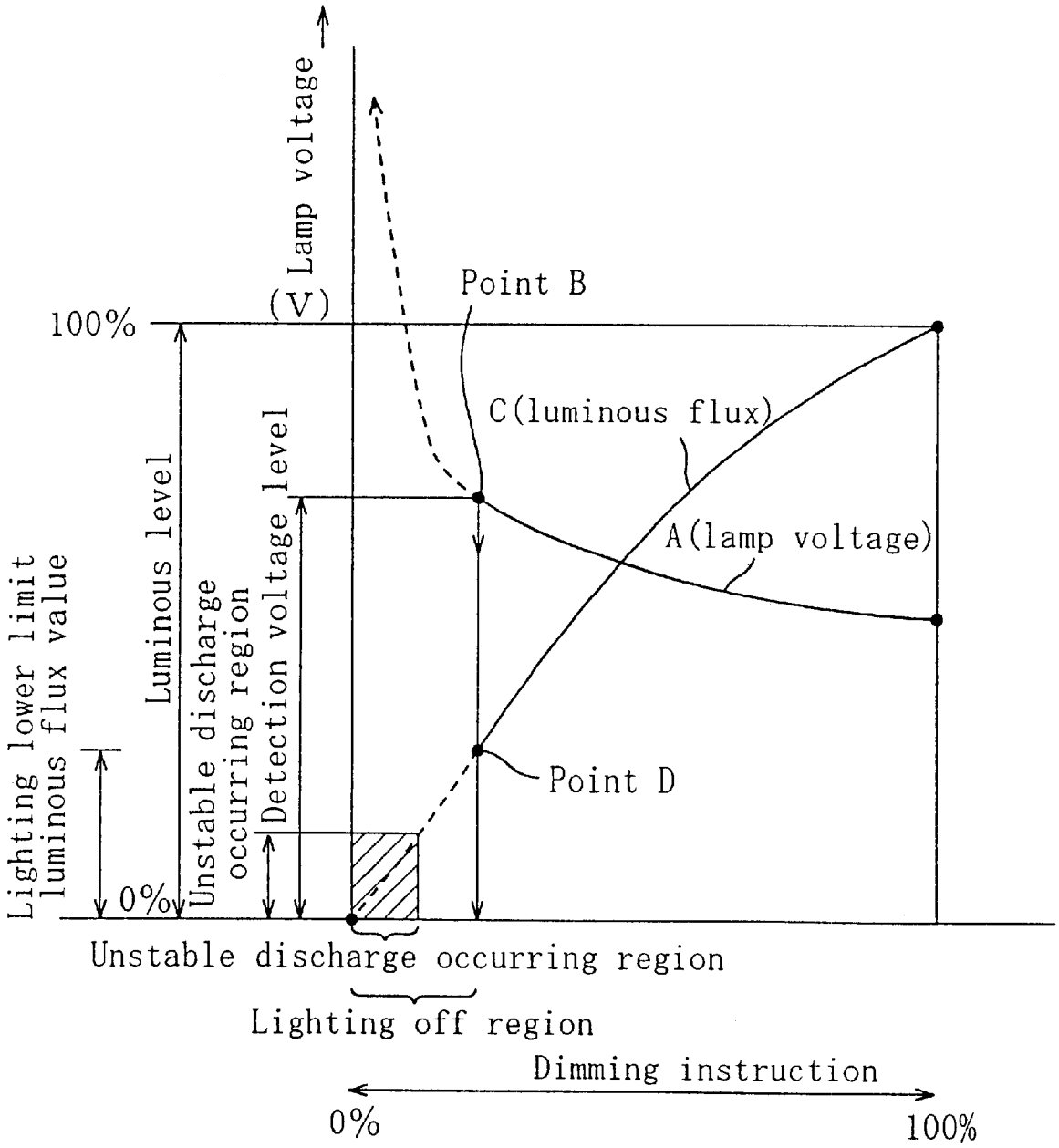
FIG. 2 is a graph showing the operation of a discharge lamp operating apparatus of an embodiment of the present invention.

The operation of the discharge lamp operating apparatus of this embodiment is as shown in FIG. 2, for example. FIG. 2 is a graph schematically showing the dimming state of the discharge lamp operating apparatus of this embodiment. The horizontal axis in FIG. 2 shows dimming instructions, and the vertical axis shows the luminous flux level of the discharge lamp that changes in response to the dimming instructions. A curve A in FIG. 2 shows the lamp voltage, and a curve C shows the luminous flux. A point B is where the discharge lamp turns off when the lamp voltage reaches this point or higher, so that the operation of the discharge lamp does not enter the unstable discharge occurring region. The point B previously can be defined by setting the circuit constant of the lamp characteristics detection circuit 22.

As shown in FIG. 2, when the luminous flux of the discharge lamp 12 is reduced from the full lighting state (100%) by dimming, the lamp characteristics detection circuit 22 detects the voltage at the point B, and allows the stop circuit 25 to operate to turn off the discharge lamp 12. In other words, the luminous flux of the discharge lamp 12 corresponding to the point B is the lower limit of the lumens flux value for dimmed lighting (a point D), and in a dimming region below the point D, the discharge lamp 12 is off.

Even when the luminous flux of the discharge lamp 12 is lowered further beyond the dimming instruction corresponding to the points B and D, the discharge lamp 12 continues to be off. In other words, at this time as well, the oscillating frequency or the ON duty of the switching element is varied by the dimming instruction signals, so that the power to be supplied to the discharge lamp is constricted. Therefore, the lamp voltage necessary for turning on the luminous lamp cannot be obtained, so that the lamp continues to be off. This off-state can be realized by the stop circuit 25 that continues to generate signals (stop signals) for stopping the operation of the control circuit 16 while output signals from the lamp characteristics detection circuit 22 are input to the stop circuit 25. Alternatively, this off-state can be realized by the stop circuit 25 that can store the stop signals.

Thus, according to the discharge lamp operating apparatus of this embodiment, it is possible to avoid unstable discharge that occurred in a low luminous flux dimming region. As a result, stable dimming operation can be achieved from the full lighting state to the lighting off state.

Figure 3:
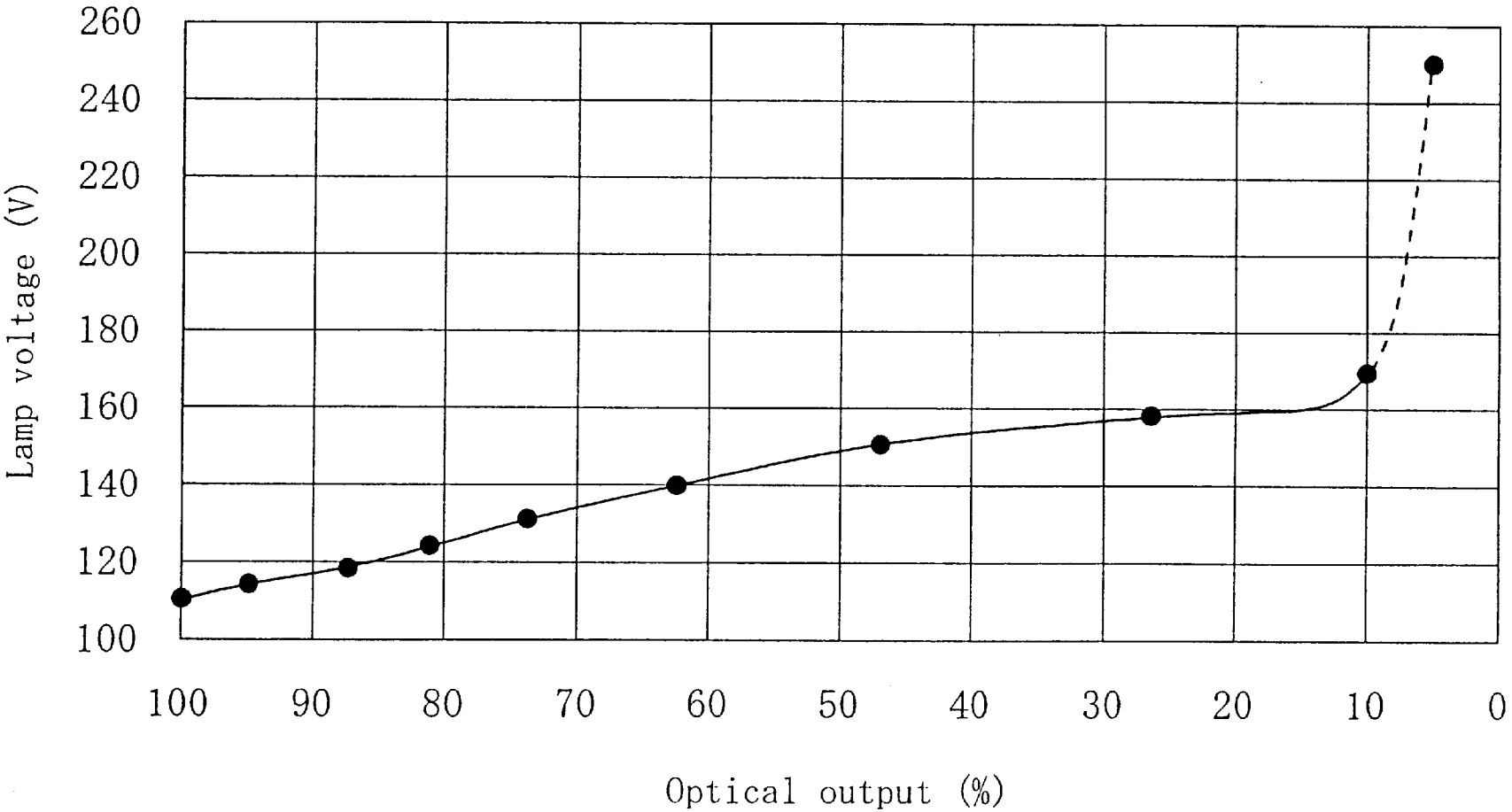
FIG. 3 is a graph showing the relationship between the optical output (%) and the lamp voltage (V) of a discharge lamp operating apparatus of an embodiment of the present invention.
Figure 4A:
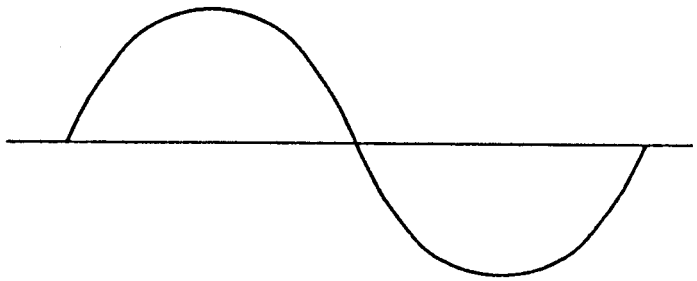
FIGS. 4A and 4B are graphs showing waveforms of AC powers.

Next, the operation of the discharge lamp operating apparatus in which unstable discharge may occur will be described with reference to FIGS. 3 to 5. FIG. 3 is a graph showing an example of the lamp voltage change during dimming. The horizontal axis in FIG. 3 shows the optical output (%), and the vertical axis shows the lamp voltage (V; effective value). This lamp voltage is shown by the effective values, and the effective lamp voltage (V) is multiplied by $2\times(2)^{1/2}$ to convert it to the lamp voltage of $V_{p-p}$. The points in FIG. 3 are obtained by the experiments of the inventors of the present invention.

As seen from FIG. 3, when the optical output is lowered from the full lighting state to the lighting off state by dimming, the lamp voltage gradually increases. In dimming up to 10% of the optical output, the lamp voltage (V) increases moderately, but when the optical output becomes below 10%, the lamp voltage (V) increases sharply. The range of this sharp increase is defined as the unstable discharge occurring region. In this case, the lamp characteristics detection circuit 22 can be set so that the stop circuit 25 is operated when the optical output becomes below 10%.

Figure 4B:
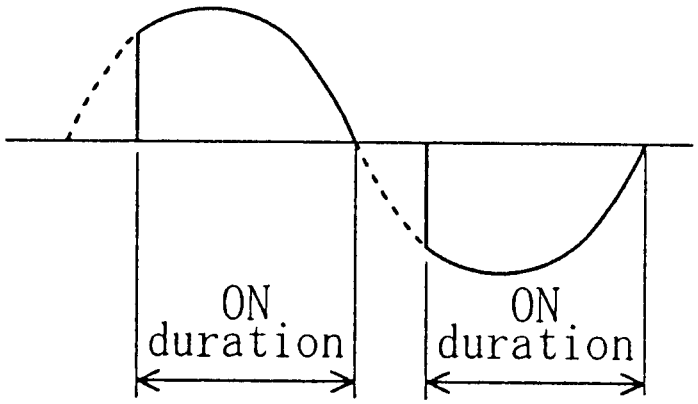

Next, an example of the following case will be described. The discharge lamp 12 is dimmed by using an AC voltage that is phase controlled, as shown in FIG. 4B, by an external phase control apparatus (e.g., a dimmer for incandescent lamps), instead of the commercial AC power 1 (see FIG. 1) having a waveform shown in FIG. 4A, and changing the ON duration of the AC voltage.

Figure 5:
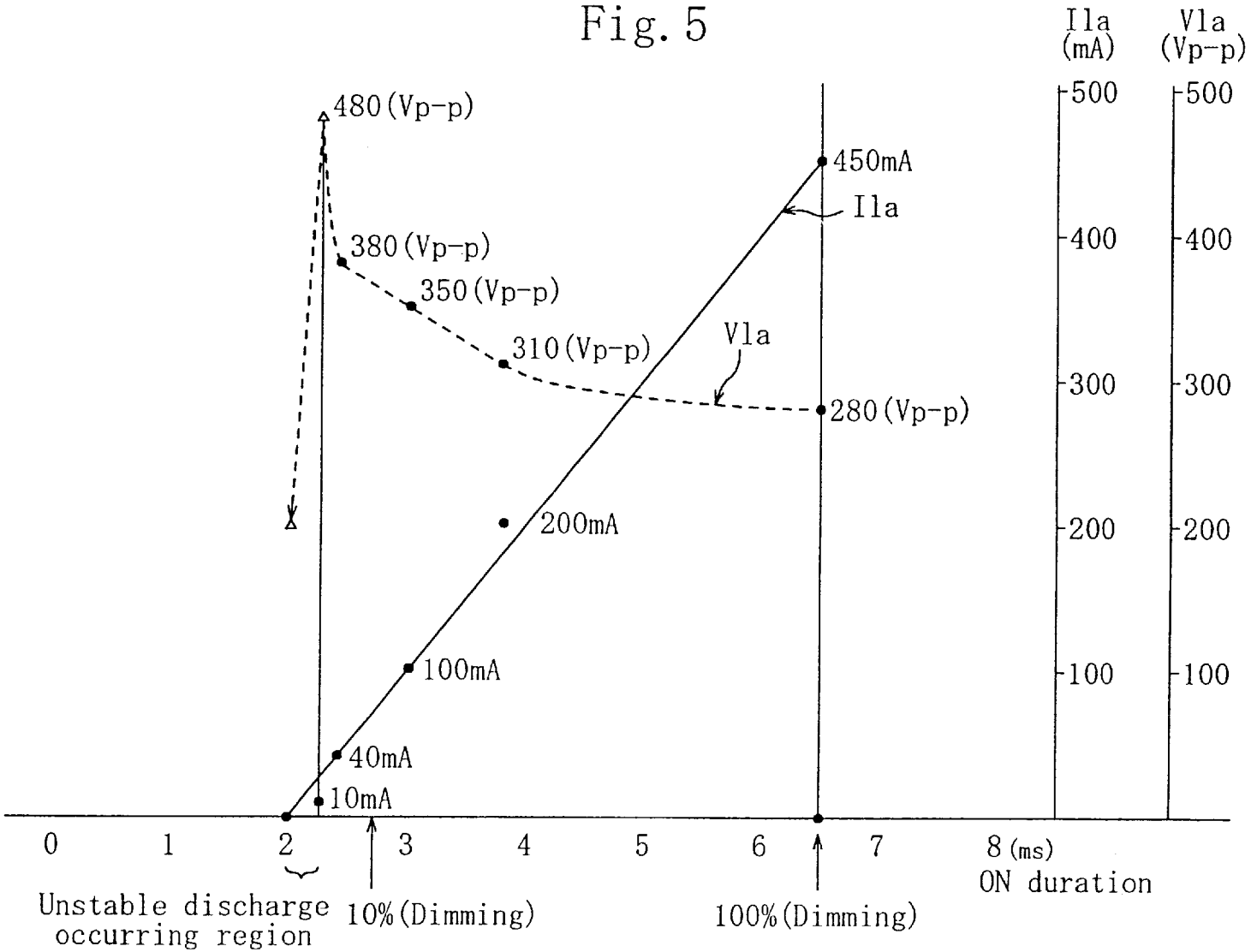
FIG. 5 is a graph showing the ON duration (mS) and the lamp voltage ($V_{p-p}$) of a discharge lamp operating apparatus of an embodiment of the present invention.

FIG. 5 shows the relationship between the ON duration (mS) and the lamp voltage (Vla) and the lamp current (Ila). The lamp voltage in the FIG. 5 is not the effective values of the lamp voltage, but the lamp voltage of $V_{p-p}$. Since FIG. 5 also shows the lamp current, in addition to the lamp voltage, a change in the supplied power with respect to the ON duration (mS) can be obtained easily from the lamp current and the lamp voltage.

As understood from FIG. 5, when the ON duration is lowered from the full lighting state (100% dimming) at about 6.5 mS, the lamp current (Ila) is reduced in a constant proportion (linearly) with respect to the ON duration. On the other hand, the lamp voltage (Via) is increased gradually up to $380V_{p-p}$ (Ila=40 mA) corresponding to about 2.5 mS of the ON duration, but beyond $380V_{p-p}$, the lamp voltage (Vla) is increased sharply and reaches 480 $_{Vp-p}$ (Ila=10 mA). In the case of this example, the range beyond a lamp voltage of 380 $V_{p-p}$ is defined as the unstable discharge occurring region, so that the circuit is set so that the discharge lamp 12 turns off at a point before reaching this region, for example, the point when the ON duration is about 2.5 ms. It is also preferable to configure the circuit so that the discharge lamp 12 turns off at a point where the dimming state reaches about 10% (about 2.7 mS), making an allowance for non-uniformity between the finished products. The point at which the discharge lamp 12 turns off can be determined, as appropriate, in accordance with the lamp characteristics or the circuit characteristics or the application. The discharge lamp 12 can turn off at 3% or 5% points, if necessary for the application. The inventors of the present invention confirmed with their experiments that even if the discharge lamp 12 turns off at a 5% point of the dimming state, unstable discharge can be suppressed.

Figure 6:
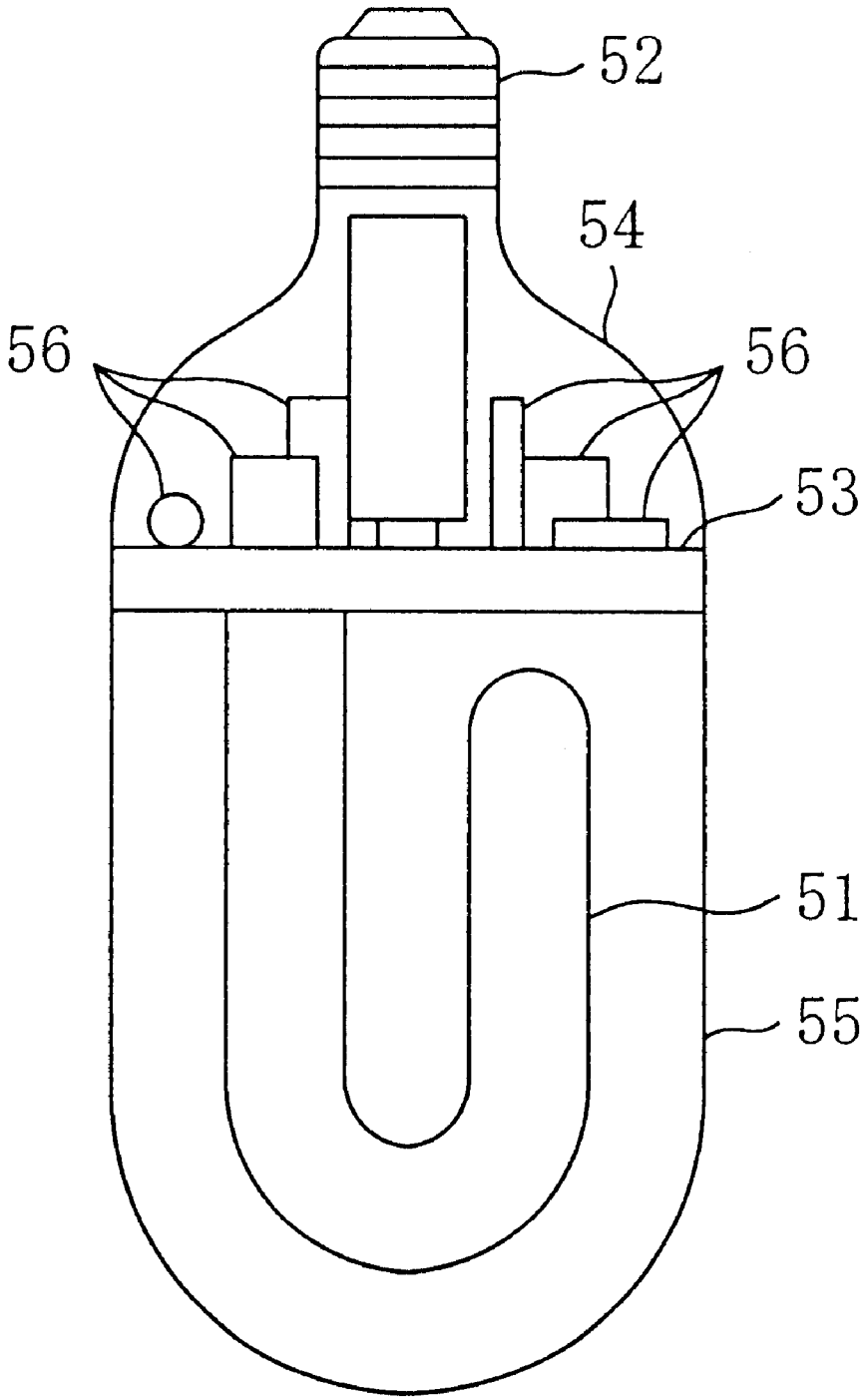
FIG. 6 is a drawing schematically showing the structure of a compact. self-ballasted fluorescent lamp of an embodiment of the present invention.

Next, the structure of the apparatus of this embodiment will be described. The discharge lamp operating apparatus of this embodiment can be constituted as a compact self-ballasted fluorescent lamp, as shown in FIG. 6. FIG. 6 schematically shows the structure of a compact self-ballasted (bulb-shaped) fluorescent lamp (22W class) of this embodiment.

The compact self-ballasted fluorescent lamp shown in FIG. 6 includes a fluorescent lamp 51, a lamp base 52 such as E26 type for incandescent lamps, a circuit substrate 53, a cover 54, and a globe 55. The fluorescent lamp 51 is a variation of the discharge lamp (fluorescent lamp) 12 shown in FIG. 1 with the shape being bent. In the circuit substrate 53, wiring for the ballast circuit shown in FIG. 1 is formed and various circuit components 56 are attached. One end of the cover 54 is attached to the lamp base 52, and the cover 54 accommodates the circuit substrate 53 therein. The globe 55 is translucent and is disposed so as to cover the circumference of the fluorescent lamp 51. The globe 55 may not be present, and the lamp base can be a lamp base other than E26 type for incandescent lamps. In the circuit substrate 53, various circuit components 56 constituting the ballast circuit are attached, but FIG. 6 only shows typical components.

The fluorescent lamp 51 is electrically connected to the circuit substrate 53, and the circuit substrate 53 is electrically connected to the lamp base 52, although not shown. Therefore, the power is supplied by threading the fluorescent lamp 51 to a socket for incandescent lamps via the lamp base 52, so that the fluorescent lamp 51 turns on. The AC voltage input via the lamp base 52 is an AC voltage that has been phase controlled by an external phase control apparatus (e.g., a dimmer for incandescent lamps).

To dim the compact self-ballasted fluorescent lamp (discharge lamp operating apparatus) shown in FIG. 6, for example, dimming can be performed with a dimmer provided on a wall of a room in which the lamp is attached, or a remote control type dimmer. The driving circuit 27 can be configured so as to vary continuously the power to be supplied to the discharge lamp 12 or vary discretely. Therefore, dimming by a dimmer may be continuous throughout the range from dimming instructions of 100% to 10%, or may be discrete (e.g., dimming instructions of 100%, 90%, . . . , 10%). When it is continuous, there is an advantage that dimming can be arbitrarily performed. When it is discrete, there is an advantage that dimming with a desired constant intensity can be easily achieved. In this embodiment, as the dimmer, volumetric phase control type dimmers can be used, or electronic phase control type dimmers can be used. In the case of the electronic phase control type, a configuration provided with a function to store brightness desired by a user (a dimmer provided with a dimming storage function) can be produced easily, so that a lighting fixture that satisfies the demand of the user can be realized.

Figure 7A:
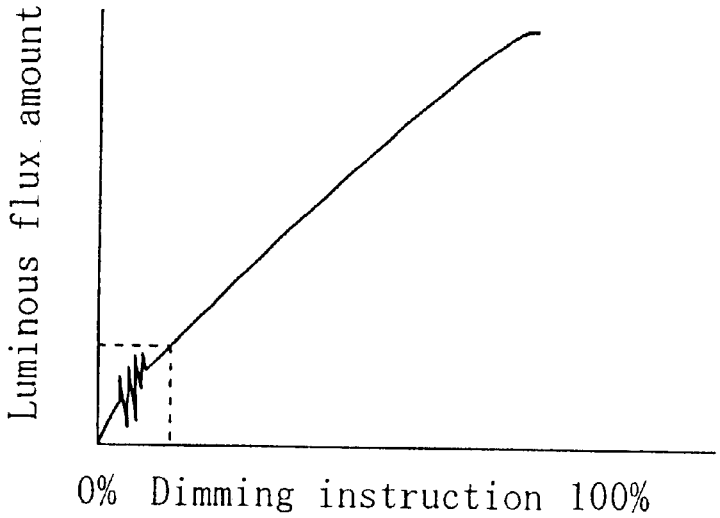
FIGS. 7A and 7B are graphs showing the dimming instruction and the luminous flux amount.
Figure 7B:
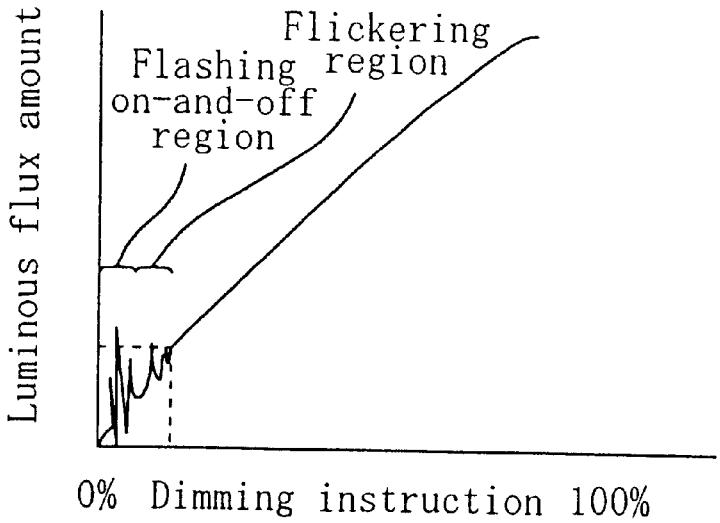

Next, a specific example of the unstable discharge occurring region, which is problematic in the prior art, will be described with reference to FIGS. 7A and 7B. FIG. 7A shows an unstable discharge occurring region when a compact self-ballasted fluorescent lamp (22W class) and a volumetric phase control type as a dimmer for dimming the lamp are used. On the other hand, FIG. 7B shows an unstable discharge occurring region (the dotted line part) when a compact self-ballasted fluorescent lamp (22W class) and an electronic phase control type as a dimmer are used. In the case of FIG. 7B, the unstable discharge occurring region (the dotted part) includes two different regions of a flashing on-and-off region and a flickering region, although the reason is not clear. Herein, "flashing on and off" means a phenomenon that the lamp is perceived as turning on and off, and "flickers" means a phenomenon that a change in the light is perceived by the eyes at a comparatively small cycle, and the light is not perceived as a steady stimulation.

In this embodiment, if the stop circuit 25 is set to operate when the dimming state is, for example, less than 10%, the entire unstable discharge occurring region including the two regions of the flashing on-and-off region and the flickering region can be avoided. In the discharge lamp of an alternating current operation, when measuring strictly with a measuring device, there may be no discharge lamps that have no flickers in a region other than the unstable discharge occurring region. Therefore, the design for the operation of the stop circuit 25 can be based on the level in which no flickers are perceived in use. In this embodiment, the configuration in which the discharge lamp 12 turns off at a supplied power value above the supplied power value at which any possible unstable discharge occurs has been described. However, if there is no problem, for example, the configuration may be such that a part of the unstable discharge occurring region (e.g., the flashing on-and-off region and a part of the flickering region) in FIG. 7B is avoided, and the other region (the other part of the flickering region) is allowed. Such a configuration where only a part of the unstable discharge occurring region is avoided is encompassed in the scope of the present invention.

Figure 8A:
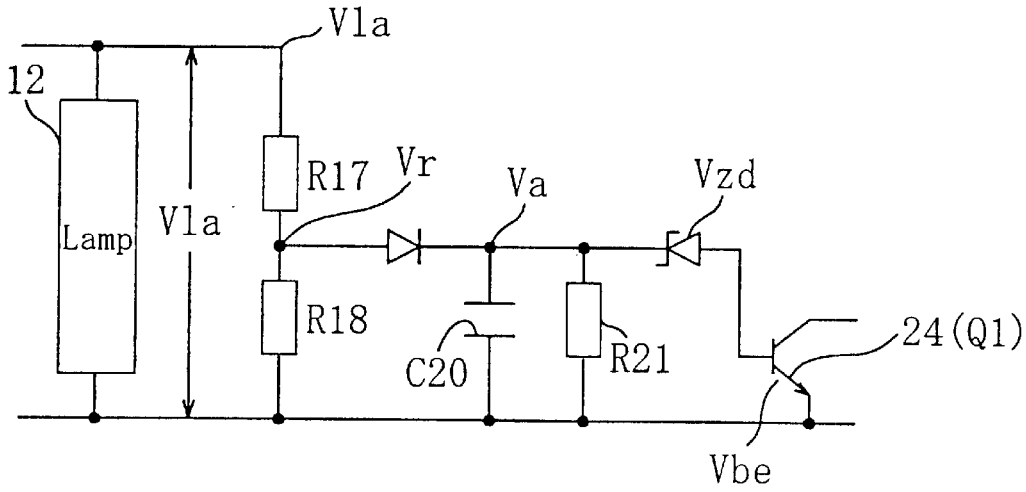
FIG. 8A is a diagram showing the configuration of a circuit of an embodiment of the present invention.
Figure 8B:
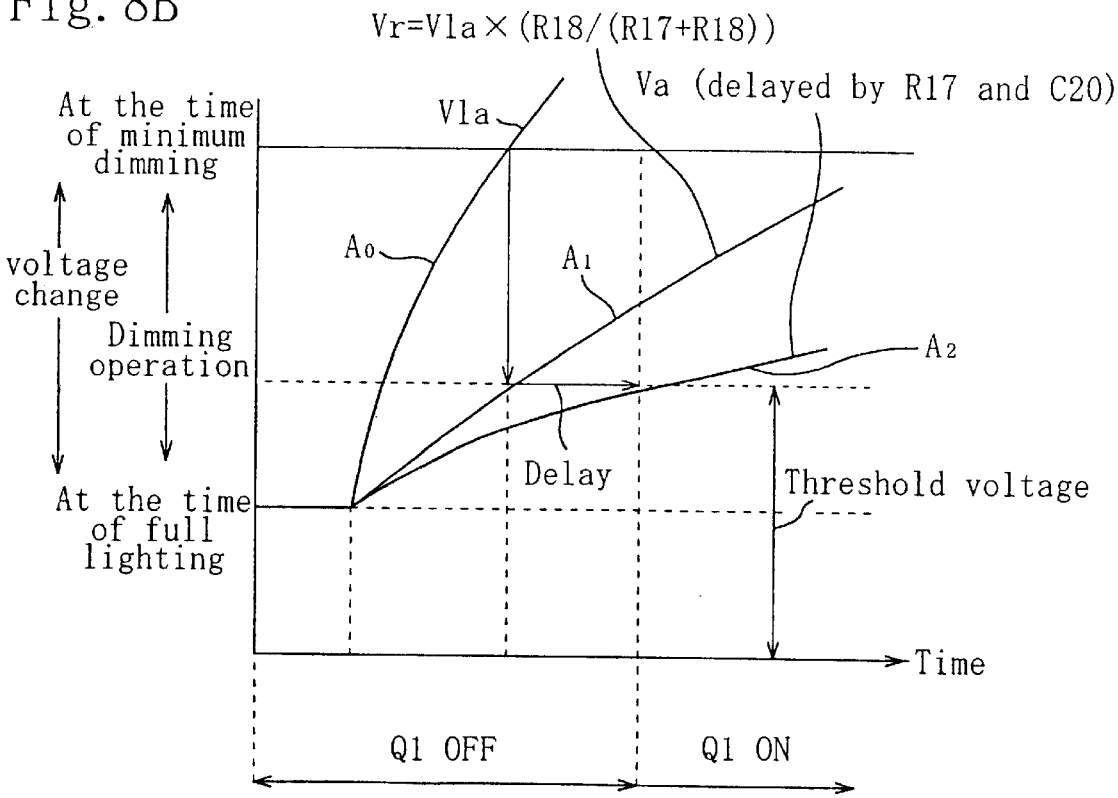
FIG. 8B is a graph showing the operation of a delay circuit and a stop circuit at the time of dimming.

Next, the operation of the delay circuit included in the lamp characteristics detection circuit 22 will be described with reference to FIGS. 8A and 8B. FIG. 8A shows a circuit configuration of a part including the discharge lamp 12, the lamp characteristics detection circuit 22, and the stop circuit 25 of the circuit shown in FIG. 1. FIG. 8B is a graph showing that the lamp voltage (Vla) is delayed by the delay circuit when dimming from the full lighting state to the minimum dimming state.

As shown in FIG. 8B, when dimming from the full lighting state to the minimum dimming state, the lamp voltage (Via) is increased. This increase of the lamp voltage (Vla; a curve $A_0$) by dimming is as shown in FIGS. 2 to 5. The lamp voltage (Vla; a curve $A_0$) first becomes a divided voltage (Vr; a curve $A_1$) with the resistors 17 and 18, and then delayed by the resistor 17 and the capacitor 20 and becomes Va (a curve $A_2$). The transistor 24 (Q1) is off, while the Va (curve $A_2$) does not exceed the threshold voltage (Vbe+Vzd) of the transistor 24 (Q1). When the Va exceeds the threshold voltage of the transistor 24 (Q1), the transistor 24 (Q1) turns on, and the discharge 12 turns off. Thus, the discharge lamp voltage (Via) is increased, and accordingly when the Va voltage with a delay exceeds the threshold voltage (Vbe+Vzd), the transistor 24 (Q1) turns on and the discharge lamp turns off.

If the delay circuit is not included and the Va voltage is not delayed, sharply increased voltage (1.5 KV or more) at the start of lighting of the lamp causes the stop circuit to operate for every lamp start, and the discharge lamp 12 turns off. In this embodiment, since the Va voltage with a delay at the time constant of the resistors 17 and the capacitor 20 is utilized, so that this disadvantages can be avoided. In other words, this delay time allows the stop circuit 25 not to operate at the lamp voltage (Via) at the start of lighting of the lamp where the lamp voltage increases sharply and drops sharply. In other words, the Va voltage with a delay drops before exceeding the threshold voltage in accordance with the lamp voltage (Vla) dropping sharply at the start of lighting, so that the stop circuit 25 can be prevented from operating. In the case where the Via never exceeds the threshold at the start of lighting, the lamp can be started as appropriate without operating the stop circuit 25. The operation of this start of lighting will be described more specifically with reference to FIG. 9.

Figure 9:
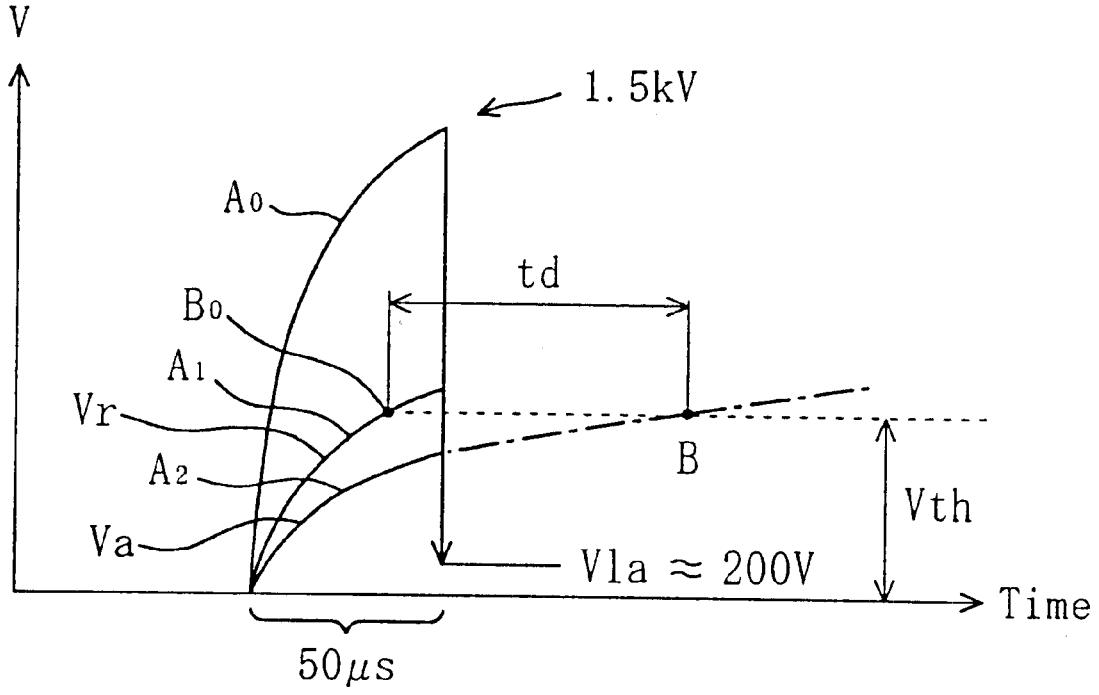
FIG. 9 is a graph showing the operation of a delay circuit and a stop circuit at the start of lighting of the lamp.

FIG. 9 is a graph showing that the stop circuit 25 does not operate at the start of lighting of the lamp by the delay circuit shown in FIG. 8A. To start the discharge lamp 12, first a sharply increased voltage (curve $A_0$) is applied. This voltage is increased to a break voltage of about 1.5 KV during about 50 $\mu$S, and when the discharge lamp 12 turns on, the voltage is stabilized at about 200V. The resistance-divided voltage (Vr; curve $A_1$) is increased sharply in accordance with the increase of the start voltage of the curve $A_0$, and exceeds the point $B_0$. However, in accordance with the drop of the start voltage of curve $A_0$, the resistance divided voltage drops to the threshold voltage (Vth) or lower. The Va voltage (curve $A_2$) with a delay from the resistance-divided voltage is increased toward the point B of Vth, but in accordance with the drop of the resistance-divided voltage, the Va voltage drops without reaching the point B. Therefore, the Va voltage never exceeds the Vth. In this manner, the stop circuit 25 is configured so that the Va voltage does not exceed the Vth at the start of lighting of the lamp, so that the stop circuit 25 can operate as appropriate during dimming and operate without malfunction occurring at the start of lighting of the lamp.

Therefore, when setting the constant of the circuit shown in FIG. 8A, it is preferable to set the constant so that the voltage can reach a predetermined voltage (e.g., Vth of Q1) or more in a moderate change of Vla voltage during dimming and the stop circuit 25 operates, whereas the circuit does not operate at a sharply increased voltage and a sharp drop at the start of lighting of the lamp. In this embodiment, with time constants of R17=272 kΩ and C20=1 $\mu$F, a time delay from the $B_0$ point to the B point is set to 0.272 seconds. Other constants of the circuit of this embodiment are as follows. R18=6.8 kΩ and R21=1 MΩ. A Zener voltage Vzd=8.2 V, and Vbe=0.6V, and the Vth (that is, Vzd+Vbe) of Q1 is 8.8V. Therefore, in the circuit configuration of this embodiment, when Va reaches 8.8V, Q1 is turned on, and the discharge lamp 12 turns off. The constants of the circuit of this embodiment are illustrative, and the circuit constant can be set as appropriate, depending on the lamp or the circuit used.

As described above, the discharge lamp operating apparatus of the present invention can realize stable dimming operation from the full lighting state to the lighting off state with a simple circuit configuration.

Next, a variation of the discharge lamp operating apparatus of this embodiment will be described with reference to FIG. 10. In the case of the discharge lamp operating apparatus of this embodiment shown in FIG. 1, the discharge lamp 12 is not lit up, when the AC power 1 is turned off in the state where the dimming level of the dimmer is reduced to, for example, 50% or less, that is, in the state where the dimming instruction is set to 50% or less, and thereafter the AC power 1 is turned on. This is because the dimming instruction signal is in the reduced dimming level, so that the necessary lamp voltage (break voltage) for the start of lighting of the lamp cannot be obtained.

Users naturally presume that turning the AC power 1 on is sufficient for turning on the discharge lamp 12, regardless of the dimming level of the dimmer. For this reason, if failing to operate the AC power 1 again when the dimming level of the dimmer is low causes a large problem to the user. Therefore, the inventors of the present invention added a function to supply the power for permitting full lighting of the dimming level to the discharge lamp 12 for a predetermined period, regardless of the dimming level of the dimmer, to the discharge lamp operating apparatus shown in FIG. 1, so that the above-described problem can be solved. FIG. 10 shows an example of a circuit configuration having this function.

Figure 10:
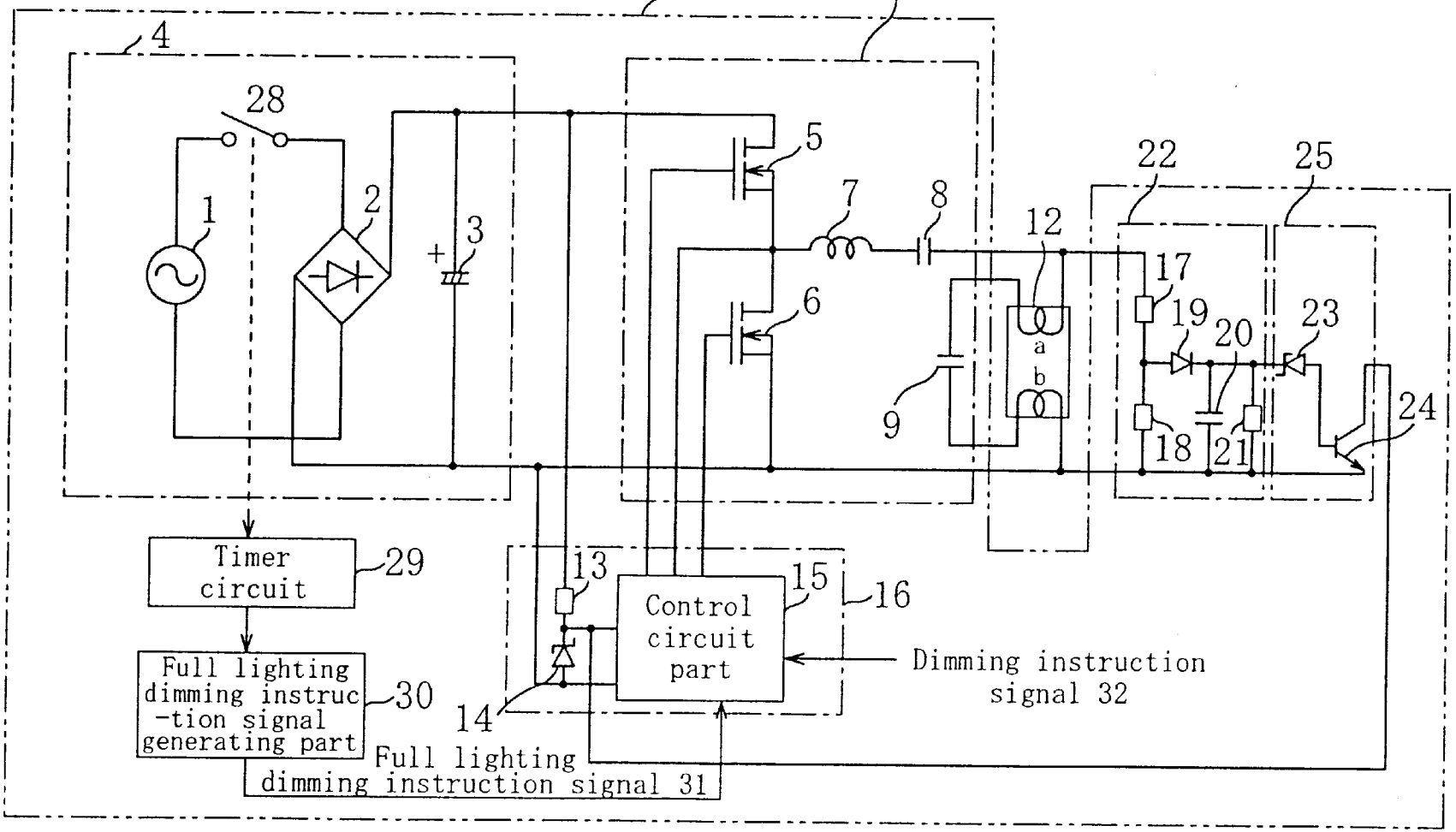
FIG. 10 is a diagram showing a configuration of a variation of a discharge lamp operating apparatus of an embodiment of the present invention.

The lamp operating apparatus shown in FIG. 10 includes a timer circuit 29 that operates for a predetermined time (e.g., 2 to 5 seconds) in connection with a switch 28 for turning on the AC power 1, and a part 30 for generating full lighting dimming instruction signals (100% dimming instruction signals) in response to outputs from the timer circuit 29. A control circuit part 15 of this lamp operating apparatus is configured to give a priority to a full lighting dimming instruction signal 31 output from the full lighting dimming instruction signal generating part 30 over a regular dimming instruction signal 32. According to this configuration, even if the AC power 1 is turned off in the state where the dimming level of the dimming instruction signal 32 is low (e.g., 50% to 20%), and then the AC power 1 is turned on again, the necessary lamp voltage for the start to turn on the lamp can be obtained by the full lighting dimming instruction signal 31 for a predetermined time (e.g., 2 to 5 seconds). Therefore, even if the regular dimming instruction signal 32 is low, the discharge lamp 12 can be started.

Thus, this variation of the embodiment of the present invention can provide an effect of easily turning on the lamp again regardless of the dimming level of the dimmer, in addition to the effects of the above-described embodiment of the present invention.

In the above-described embodiments, the configuration of a compact self-ballasted fluorescent lamp has been described. However, the present invention is not limited thereto, and the present invention can apply to regular fluorescent lamps other than compact self-ballasted fluorescent lamps. Moreover, the discharge lamp 12 can be a high pressure discharge lamp instead of a fluorescent lamp.

Furthermore, the configurations of the lamp characteristics detection circuit 22 and the stop circuit 25 are not limited to the above-described configuration, and can be any configuration, as long as they have the necessary functions. Furthermore, the transistor 24 of the stop circuit 25 can be a thyristor, a MOSFET transistor or others, as long as it is a switching element. Similarly, the power MOSFETs 5 and 6 can be other types of switching elements.

In addition, instead of the commercial AC power 1 used in the DC power 4, the phase controlled AC power as described above can be used. Moreover, in the above-described embodiments, the power source part of the control circuit 16 is stopped by the stop circuit 25 to stop the switching of the power MOSFETs 5 and 6. However, the oscillating circuit of the control circuit part 15 can be directly stopped, or switching can be stopped by highly deviating the frequency from the resonance frequency of the LC resonance circuit including the discharge lamps or others.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A discharge lamp operating apparatus comprising a fluorescent discharge lamp and a driving circuit of the fluorescent discharge lamp, wherein the driving circuit can vary power to be supplied to the fluorescent discharge lamp and has a function to turn off the fluorescent discharge lamp at a supplied power value above a supplied power value at which unstable discharge occurs in the fluorescent discharge lamp.

2. The discharge lamp operating apparatus of claim 1, wherein the driving circuit comprises:

a DC power;

a DC/AC converting circuit connected to the discharge lamp at its output terminal, including a switching element for converting an output from the DC power to alternating current;

a control circuit for varying an oscillating frequency or an ON duty of the switching element, to thereby vary and control the power to be supplied to the discharge lamp;

a lamp characteristics detection circuit for detecting that the power supplied to the discharge lamp has reached a predetermined value; and a stop circuit for generating a signal for stopping an operation of the control circuit when the predetermined value is reached.

3. The discharge lamp operating apparatus of claim 2, wherein the lamp characteristics detection circuit includes a delay circuit for delaying an output signal for a predetermined time.

4. The discharge lamp operating apparatus of claim 2, wherein the stop circuit generates a signal for stopping an operation of the control circuit while the stop circuit receives an output signal from the lamp characteristics detection.

5. The discharge lamp operating apparatus of claim 1, which is constituted as a compact self-ballasted fluorescent lamp.

6. The discharge lamp operating apparatus of claim 1, wherein the driving circuit can vary the power to be supplied to the discharge lamp continuously or discretely, thereby permitting dimming of the discharge lamp continuously or discretely.

7. The discharge operating apparatus of claim 1, wherein the driving circuit can vary power according to an AC voltage that is phase controlled.

8. A discharge lamp operating apparatus comprising a discharge lamp and a driving circuit of the discharge lamp, wherein the driving circuit can vary power to be supplied to the discharge lamp and has a function to turn off the discharge lamp at a supplied power value above a supplied power value at which unstable discharge occurs in the discharge lamp, and the discharge lamp operating apparatus further comprises means for supplying power for a dimming level of a full lighting state to the discharge lamp for a predetermined period of time, regardless of a dimming level of the discharge lamp operating apparatus.

9. The discharge lamp operating apparatus of claim 8, wherein the driving circuit comprises:

a DC power;

a DC/AC converting circuit connected to the discharge lamp at its output terminal, including a switching element for converting an output from the DC power to alternating current;

a control circuit for varying an oscillating frequency or an ON duty of the switching element, to thereby vary and control the power to be supplied to the discharge lamp;

a lamp characteristics detection circuit for detecting that the power supplied to the discharge lamp has reached a predetermined value; and a stop circuit for generating a signal for stopping an operation of the control circuit when the predetermined value is reached, and the means for supplying power for a full lighting state for a predetermined period of time comprises:

a timer circuit that operates for a predetermined period of time in connection with a switch for turning on the AC power; and a full lighting dimming instruction signal generating part for generating a full lighting dimming instruction signal for setting a dimming level to a level for a full lighting state, in response to an output from the timer circuit, and outputting the signal to the control circuit, and the control circuit includes a function to process the full lighting dimming instruction signal from the full lighting dimming instruction signal generating part before a dimming instruction signal for varying and controlling the power to be supplied to the discharge lamp, whereby the power for the full lighting state is supplied to the discharge lamp.

10. The discharge operating apparatus of claim 8, wherein the driving circuit can vary power according to an AC voltage that is phase controlled.

11. The discharge lamp operating apparatus of claim 8, which is constituted as a compact self-ballasted fluorescent lamp.

12. The discharge lamp operating apparatus of claim 8, wherein the driving circuit can vary the power to be supplied to the discharge lamp continuously or discretely, thereby permitting dimming of the discharge lamp continuously or discretely.

13. The discharge lamp operating apparatus of claim 8, wherein the discharge lamp is a fluorescent discharge lamp.

14. A discharge lamp operating apparatus comprising a discharge lamp and a driving circuit of the discharge lamp, wherein the driving circuit can vary power according to an AC voltage that is phase controlled, to be supplied to the discharge lamp and has a function to turn off the discharge lamp at a supplied power value above a supplied power value at which unstable discharge occurs in the discharge lamp.

15. The discharge lamp operating apparatus of claim 14, which is constituted as a compact self-ballasted fluorescent lamp.

16. The discharge lamp operating apparatus of claim 14, wherein the driving circuit can vary the power to be supplied to the discharge lamp continuously or discretely, thereby permitting dimming of the discharge lamp continuously or discretely.

17. The discharge lamp operating apparatus of claim 14, wherein the discharge lamp is a fluorescent discharge lamp.

18. A driving circuit for a fluorescent discharge lamp, wherein the driving circuit can vary power to be supplied to the fluorescent discharge lamp and has a function to turn off the fluorescent discharge lamp at a supplied power value above a supplied power value at which unstable discharge occurs in the fluorescent discharge lamp.

19. The driving circuit operating apparatus of claim 18, wherein the driving circuit comprises:

a DC power;

a DC/AC converting circuit connected to the discharge lamp at its output terminal, including a switching element for converting an output from the DC power to alternating current;

a control circuit for varying an oscillating frequency or an ON duty of the switching element, to thereby vary and control the power to be supplied to the discharge lamp;

a lamp characteristics detection circuit for detecting that the power supplied to the discharge lamp has reached a predetermined value; and a stop circuit for generating a signal for stopping an operation of the control circuit when the predetermined value is reached.

20. The discharge operating apparatus of claim 19, wherein the lamp characteristics detection circuit includes a delay circuit for delaying an output signal for a predetermined time.

21. The discharge operating apparatus of claim 19, wherein the stop circuit generates a signal for stopping an operation of the control circuit while the stop circuit receives an output signal from the lamp characteristics detection.

22. The discharge lamp operating apparatus of claim 18, which is constituted as a compact self-ballasted fluorescent lamp.

23. The discharge lamp operating apparatus of claim 18, wherein the driving circuit can vary the power to be supplied to the discharge lamp continuously or discretely, thereby permitting dimming of the discharge lamp continuously or discretely.

24. The discharge operating apparatus of claim 18, wherein the driving circuit can vary power according to an AC voltage that is phase controlled.

25. A driving circuit for a discharge lamp, wherein the driving circuit can vary power to be supplied to the discharge lamp to control dimming of the discharge lamp and has a function to turn off the discharge lamp at a supplied power value above a supplied power value at which unstable discharge occurs in the discharge lamp.

26. The driving circuit apparatus of claim 25, wherein the driving circuit can vary power according to an AC voltage that is phase controlled.

27. The driving circuit operating apparatus of claim 25, wherein the discharge lamp is a fluorescent discharge lamp.

* * * * *

UNITED STATES PATENT AND TRADEMARK OFFICE

CERTIFICATE OF CORRECTION

PATENT NO. : 6,504,322 B2
DATED : January 7, 2003
INVENTOR(S) : Takahashi et al.

It is certified that error appears in the above-identified patent and that said Letters Patent is hereby corrected as shown below:

Title page,
Item [56], References Cited, FOREIGN PATENT DOCUMENTS, insert -- JP 09245979A 9/1997 -- and -- JP Office Action 1/2002 --.

Signed and Sealed this

Tenth Day of August, 2004

JON W. DUDAS
*Acting Director of the United States Patent and Trademark Office*